United States Patent [19]

d'Elloy

[11] 4,353,703

[45] Oct. 12, 1982

[54] NAUTICAL PROPULSION DEVICE

[76] Inventor: Xavier d'Elloy, Les Quéras-Audes, 03190 Herisson, France

[21] Appl. No.: 220,065

[22] PCT Filed: Apr. 23, 1980

[86] PCT No.: PCT/FR80/00064

§ 371 Date: Dec. 9, 1980

§ 102(e) Date: Dec. 9, 1980

[87] PCT Pub. No.: WO80/02270

PCT Pub. Date: Oct. 30, 1980

[30] Foreign Application Priority Data

Apr. 25, 1979 [FR] France ..... 79 10464

[51] Int. Cl.[3] ..... B63H 16/12

[52] U.S. Cl. ..... 440/21; 440/94

[58] Field of Search ..... 9/11 A, 2 A; 440/90–94, 26, 28, 27, 21

[56] References Cited

U.S. PATENT DOCUMENTS

| | | | |
|---|---|---|---|
| 515,682 | 2/1894 | Hoeft | 440/94 |
| 2,940,415 | 6/1960 | Schwarzer | 440/29 |
| 3,614,939 | 10/1971 | Dib | 440/94 |

FOREIGN PATENT DOCUMENTS

| | | | |
|---|---|---|---|
| 935110 | 6/1948 | France . | |
| 1010064 | 7/1948 | France | 440/26 |
| 2050330 | 2/1971 | France . | |
| 2389531 | 1/1978 | France . | |

*Primary Examiner*—Trygve M. Blix
*Assistant Examiner*—Stephen P. Avila
*Attorney, Agent, or Firm*—Michael Ebert

[57] ABSTRACT

A pedal-operated nautical propulsion device for small craft, such as a pneumatic raft. The device comprises a pedal crank system producing circular motion which is transmitted by a frame-supported mechanism to a holder carrying a paddle to cause the paddle to undergo translation in a vertical plane, whereby the paddle is plunged in the water to propel the craft and then raised thereabove. The mechanism which makes it possible for the paddle to extend well forward of the pedal crank system includes a bar coupled to the system to transmit the motion thereof, the end of the bar being hingedly connected to the end of the paddle holder. Further included are first and second interhinged connecting rods, the end of the first rod being hinged to the bar and the end of the second rod being hinged to the paddle holder to define a deformable quadrilateral structure.

9 Claims, 5 Drawing Figures

NAUTICAL PROPULSION DEVICE

BACKGROUND OF INVENTION

This invention relates generally to nautical propulsion devices for small crafts, and more particularly to pedal-operated propulsion devices making it possible to propel a craft while lying down or being seated thereon by a paddling action produced by pedal rotation of a crankshaft.

Paddle propulsion devices are already known, as evidenced by the French Pat. No. 935,110 (Stringa) and the French Pat. No. 2,389,531 (d'Elloy). The Stringa patent employs a complex mechanism of chains and pinions in order to impart a circular vertical translation movement to the paddles. A movement of this type is not conductive to efficient propulsion. The d'Elloy patent brings about a considerable improvement in the efficiency of propulsion and simplifies the mechanism therefor.

However, the mechanisms disclosed in these prior patents both have the disadvantage of requiring that the paddles be rather close to the frame which supports the mechanism. The use of these mechanisms is therefore limited, for all practical purposes, to crafts provided with floats. These prior art mechanisms are therefore not adapted to operate with other small craft available on the market, such as those of the pneumatic type.

SUMMARY OF INVENTION

In view of the foregoing, the main object of this invention is to provide a simple and practical nautical propulsion device for small craft which operates efficiently and reliably.

More particularly, an object of the invention is to provide devices of the above type in which the mechanism for actuating the paddles is mounted on a frame and which makes it possible to arrange the paddles at a distance therefrom sufficient to render the devices usable with practically all types of small craft available on the market, including the pneumatic type.

Briefly stated, these objects are attained in a paddle-operated propulsion device in accordance with the invention which may be fastened to the front or rear of a small boat such as a pneumatic raft on which one can lie down in order to paddle.

This propulsion device essentially comprises a frame provided with means for attachment to the craft. This frame, for example, may be a tubular rectangular frame to which there are connected fixed supports for a pedal crank system, and bent bars articulated either at one end to the pedal crank system and bearing at the other end propulsion paddles as well as connecting rods connected at one of their ends to each of the two paddle-holder bars and at their other common end to a point of the pedal crank system support, or to the top of the pedal crank system support frame and to the base of the connecting rods articulated in the vicinity of the axis of the pedal.

In accordance with one characteristic of the invention, the length of these connecting rods is such that together with the bent bars bearing the paddles they form a deformable quadrilateral in such a manner that when each pedal describes a circle, the bend of each paddle-holding rod and the corresponding paddle describe a vertical curve of elliptical form. In this way the rotation of the pedal crank system causes a continuous, uniform movement of the propulsion paddles.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
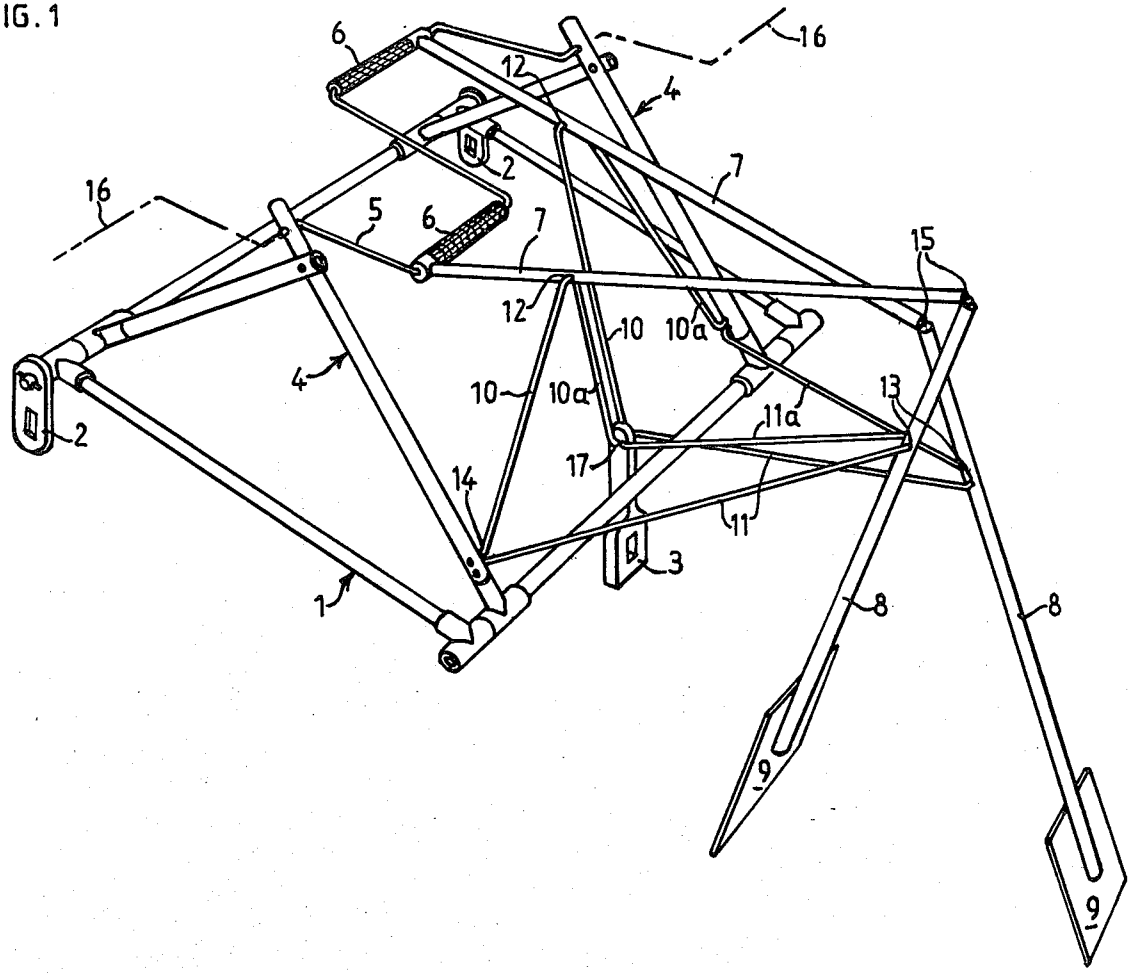
FIG. 1 is a view in perspective view of the first embodiment.

As shown in the drawings, the propulsion device, as shown in FIG. 1, comprises a rectangular tubular frame 1 provided with fastening plates 2 and 3 or other means for attachment to a craft (not shown). On each side of this frame there are secured two triangles 4 formed by bars which support a pedal crank system 5. On each pedal 6 of the crank system there is pivotally attached a bar 7 which is divided into two parts, the second part 8 thereof holding a propulsion paddle 9.

Bars 7 and 8 are controlled by connecting rods 10 and 11 which are articulated at coupling points 12 and 13 and at a common point 14 on support 4. These points are selected in a manner forming an irregular quadrilateral (7,8,10,11) so designed that a circular movement of each pedal 6 causes an approximately elliptical vertical displacement of the associated paddle 9.

For this purpose, the length of paddle holder 8 between its elbow 15 and hinge 13 of connecting rod 11 is smaller than the length of bar 10 between its hinge 12 on bar 7 and its hinge 14 on support 4, while the length of bar 7 between its elbow 15 and hinge 12 is smaller than the length of bar 11 between its hinge points 13 and 14.

By way of example, for a bar 7 of 92 cm articulated to paddle holder bar 8 of 84 cm, the distance between points 12 and 15 will be 58 cm, the distance between points 13 and 14 will be 66 cm, the distance between points 12 and 14 will be 34 cm, and that between points 13 and 15 will be 20 cm approximately.

Due to such dimensioning of the deformable quadrilateral. paddles 9 will undergo a cyclical movement in the vertical plane during which it plunges into the water and then emerges. In this example, connecting rods 10 and 11 may be in the form of piano wires or double rods articulated at point 14 on the lateral support 4 and at points 17 on the central fastening plate 3.

Figure 2:
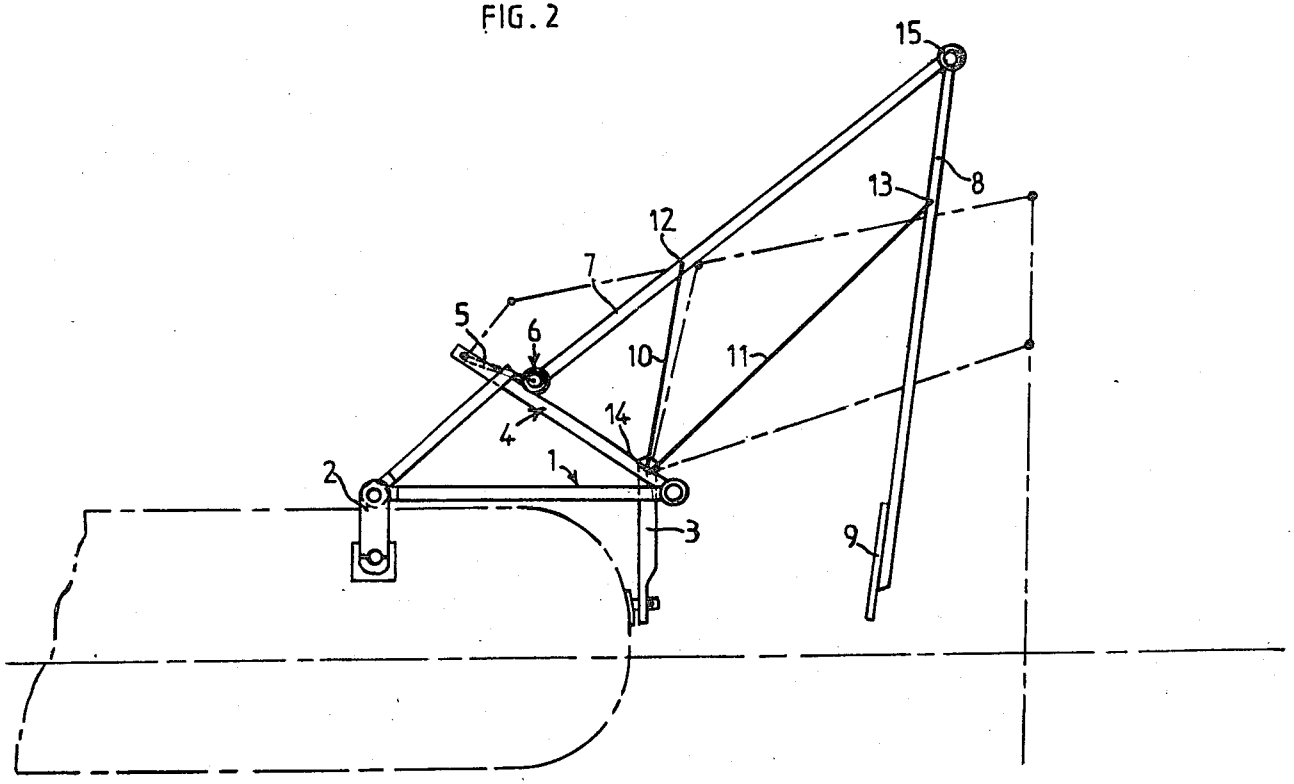
FIG. 2 is a geometrical diagram showing the movement of the paddles.

In FIG. 2 the device is shown in solid line in the position of FIG. 1 and in dot-dash line in an intermediate position of pedals 6. This device can be readily adapted for a craft for two persons or more by adding on each side, the pedals 16, as indicated in broken line in FIG. 1. In order to provide adequate foot (or hand) space, each bar 7 is positioned to one side of pedal 6. This also permits the crossing of paddles which are wider and therefore more effective.

In order to provide good stability, each bipartite connecting rod (10 and 117 is formed of two piano wire arms 10, 10*a* and 11*a* defining a right triangle whose vertical side passes through the portion of the associated rod 7 and assumes the direction of the hypotenuse. At the base, the ends are turned to align themselves on the same axis parallel to the axis of the pedals and of the turned portion of the apex of the triangle. On one side, they pass into the upright to connect with the pedal crank system and on the other into fastening plate 3 connecting the raft to the front tube of the frame. To collapse the device, it is sufficient to release the attachments of these connecting rods.

Figure 3:
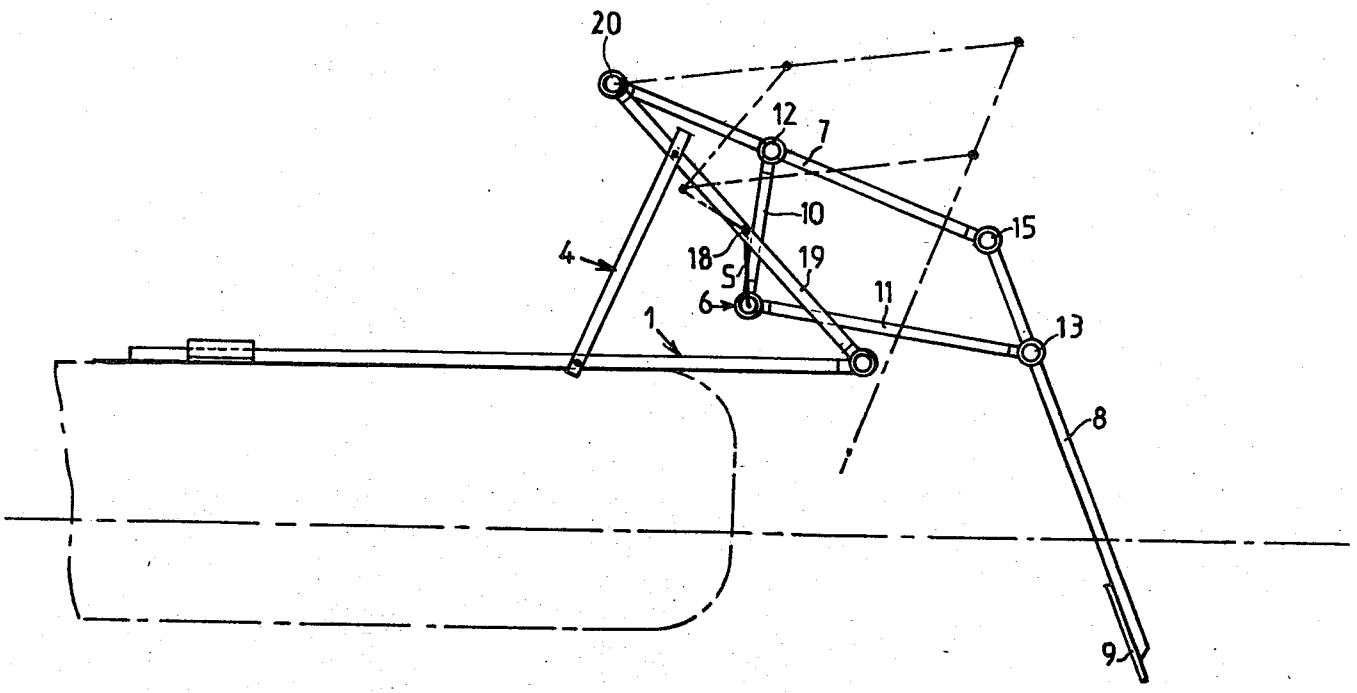
FIG. 3 is a view similar to the preceding view of the second embodiment.

In the embodiment of FIG. 3, the articulation of the pedal crank system 5 is effected at a coupling point 18 on the rod 19 held by the support 4. Bar 7 has its point of rest on the apex 20 on a gantry above the pedals, while the connecting rods 10 and 11 are articulated from the pedal. For ease in assembly, the upper connecting rod 10 is articulated not on the pedal but on connecting rod 11 at a distance close to the pedal. The connecting rods are relatively rigid and may be made of wood or plastic.

Figure 4:
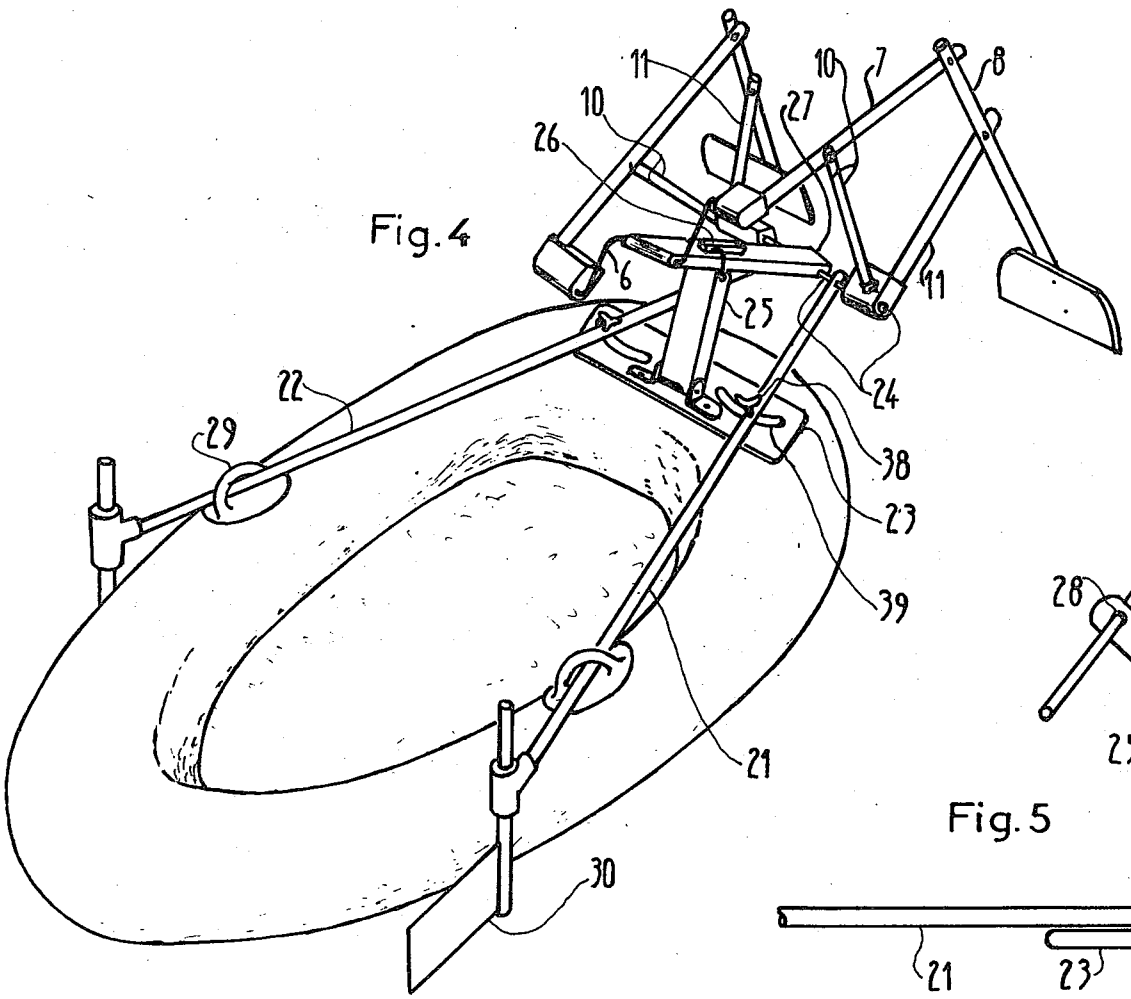
FIG. 4 is a view in perspective of a third embodiment of the means of fastening the propulsion device.
Figure 5:
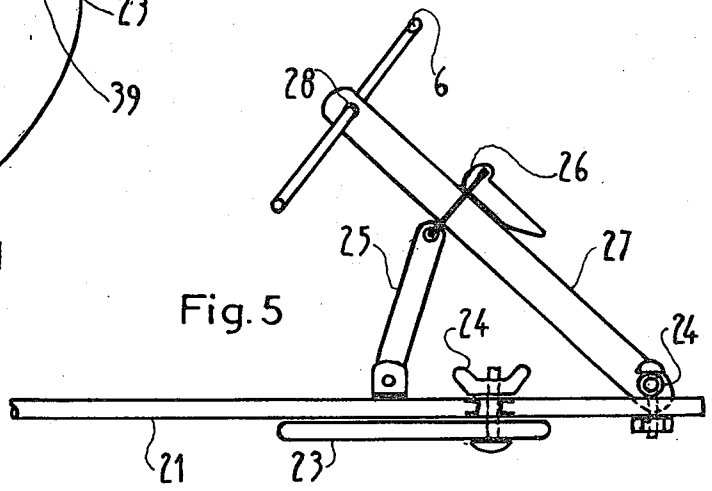
FIG. 5 shows a detail in elevation of the device of the preceding figure.

In FIGS. 4 and 5 there is shown a propulsion mechanism similar to that of FIGS. 1 and 2, the mechanism being supported by a frame having a special structure which facilitates ease of attachment to a conventional pneumatic boat or raft.

This frame is essentially composed of two tubular bars 21 and 22, an anchor plate 23, and an articulation shaft 24. Bars 21 and 22 are connected at their ends to articulation shaft 24 and, at a certain intermediate point of their length, to plate 23. Thus bars 21, 22 and plate 23 define an A-shaped structure, the attachment of the bars to the plate being effected by bolts 38 which pass through holes 39. These holes in plate 23 have the shape of a circular arc so that the angle formed by the bars is adjustable.

Above anchor plate 23 and hinged thereto is an arm 25 whose upper end is provided with a wedging member 26 intended to be received and to wedge in a beam 27 acting as the support for the pedal crank system. Beam 27, as best seen in FIG. 5, is connected at one end to articulation shaft 24, the other end of beam 27 having a bearing 28 to receive the shaft of pedal crank system 6. Beam 27 is secured at its intermediate portion by means of wedge member 26 to the upper end of arm 25.

Arm 25 and the pedal crank system support beam 27 are thereby connected at their lower end to the A-shaped structure to form a rigid triangular superstructure contained in a vertical plane perpendicular to the plane of the A-shaped structure. The inclination of the pedal crank system support beam 27 can be adjusted by sliding this beam in wedging member 26, as a function, for instance, of the load on the boat and in such a manner that the ellipse described by the paddles has optimum immersion below the surface of the water.

Articulation shaft 24 also serves as a fixed point on which there are hinged connecting rods 10 and 11 for one of the vertices of the deformable quadrilateral.

It will be appreciated that after having loosened wedge 26 and bolts 38, the assembly formed by bars 21 and 22, plate 23, articulation shaft 24, arm 25 and pedal crank system support beam 27 can then be swung back into a plane and thereby take up a minimum amount of space in thickness and width. Furthermore, if bar 7 can be removed both from connecting rod 10 and from pedal 6, the assembly of the coupling parts can also be swung back in the same plane. Thus the device may be easily folded into a compact form.

It is apparent from the drawing that bars 21 and 22 are designed to pass through the oar cleat 29 with which pneumatic crafts are generally provided. In practice, the end of bars 21 and 22 can also serve as supports for rudders such as rudder 30.

Devices of the type described above can readily be installed in a pneumatic raft, a round buoy or a boat. They may be used for pleasure or for life-saving purposes, the devices providing effective propulsion on both calm and agitated waters. Because of its lightness and its folding capability, and the small amount of space taken up thereby, it becomes possible to store these devices on a ship as a life-saving or service means. A device in accordance with the invention can be carried easily on foot or by car to the shore to provide a pleasure boat.

It is to be understood that the invention is not limited to the embodiments described herein and that, depending on the use of this propulsion means and the nature of the craft, one may vary the shape of the chassis and the supports of the pedal crank system as well as the dimensions of the rods.

I claim:

1. A paddle-operated propulsion device for small water craft such as a pneumatic raft, said device comprising:

A. a pedal crank system to produce circular motion;

B. a holder carrying a paddle; and

C. a frame-supported mechanism which makes it possible for the paddle to extend well in front of the crank system while transmitting the circular motion of the crank system to the paddle holder to cause the paddle to undergo translation in a vertical plane whereby the paddle is plunged into the water to propel the craft and then raised thereabove, said mechanism including a bar coupled to the crank system to transmit the motion thereof, one end of the bar being hingedly connected to the end of the paddle holder, first and second connecting rods joined together at a hinged junction point, the end of the first rod being pivotally connected to the bar and the end of the second rod being pivotally connected to the holder to define therewith a deformable quadrilateral structure, said frame being constituted by a pair of bars whose ends are coupled to an articulation shaft, the frame bars being connected at intermediate points thereon to an anchor plate to define an A-shaped structure.

2. A propulsion device as set forth in claim 1, wherein said first rod is pivotally connected to said bar at an intermediate point thereon and said second rod is pivotally connected to said holder at an intermediate point thereon, said hinged junction point of the first and second rods being connected to a fixed point on the frame supporting this mechanism.

3. A propulsion device as set forth in claim 2, wherein said frame includes a triangular upright mounted on a rectangular base, said fixed point being on said upright.

4. A propulsion device as set forth in claim 2, further including means on said frame to effect attachment thereof to said craft.

5. A propulsion device as set forth in claim 2, wherein the side of the quadrilateral structure which includes said bar is smaller than the side which includes said second rod, and the side which includes the paddle holder is smaller than the side which includes said first rod.

6. A propulsion device as set forth in claim 1, wherein said first and second connecting rods are each formed by an angled pair of rod sections to effect lateral stabilization of the bar and paddle holder.

7. A propulsion device as set forth in claim 1, wherein said pedal crank system includes a pedal engageable by a hand or foot, and the other end of said bar is hingedly connected to said system at one side of the pedal.

8. A propulsion device as set forth in claim 1, further including a support beam for said pedal crank system, said beam being pivoted at one end on said articulation shaft, and an arm, one end of which is hingedly connected to said anchor plate and whose other end has a wedge to couple the arm to the beam.

9. A propulsion device as set forth in claim 8, wherein the connection of the frame bars to the anchor plate is at least one arcuate slot in the plate which is effected by a pair of bolts passing through arcuate slots in the plate to permit angular adjustment of the bars.

* * * * *